US005782411A

United States Patent [19]

Potter

[11] Patent Number: 5,782,411

[45] Date of Patent: Jul. 21, 1998

[54] SOLENOID STATOR ASSEMBLY FOR AN ELECTROMECHANICALLY ACTUATED FUEL INJECTOR

[75] Inventor: Kenneth Ray Potter, Kalamazoo, Mich.

[73] Assignee: Diesel Technology Company, Wyoming, Mich.

[21] Appl. No.: 779,983

[22] Filed: Dec. 23, 1996

[51] Int. Cl.[6] ..... F02M 51/00

[52] U.S. Cl. ..... 239/88; 239/585.1; 335/281; 336/234

[58] Field of Search ..... 239/595.1, 88; 336/234; 335/281

[56] References Cited

U.S. PATENT DOCUMENTS

| | | | |
|---|---|---|---|
| 2,510,598 | 6/1950 | Oles | 336/234 |
| 3,562,686 | 2/1971 | Borschers | 335/281 |
| 3,586,964 | 6/1971 | Strauch | 239/234 |
| 4,366,944 | 1/1983 | Kah , Jr. | 251/129.06 |
| 4,568,021 | 2/1986 | Deckard et al. . | |
| 4,708,317 | 11/1987 | Hiyama | 239/585.3 |
| 5,155,461 | 10/1992 | Teerman et al. . | |
| 5,592,905 | 1/1997 | Born | 251/129.01 |
| 5,608,368 | 3/1997 | Ricco et al. | 335/281 |

FOREIGN PATENT DOCUMENTS

| | | | |
|---|---|---|---|
| 1096434 | 6/1984 | U.S.S.R. | 251/129.01 |

*Primary Examiner*—Kevin Weldon
*Attorney, Agent, or Firm*—Bill C. Panagos

[57] ABSTRACT

An electromechanically actuated fuel injector and a solenoid stator assembly for an electromechanically actuated fuel injector are disclosed. The solenoid stator assembly comprises a cup shaped stator core assembly comprised of a plurality of magneto-conductive wire members of a predetermined length arranged in parallel, adjacent and abutting relationship relative to an adjacent wire member. These wire members are bound at one end thereof for some length less than the entire length of the wire members to form a central pole piece, and splayed umbrella like about the central pole piece at the opposite end thereof to form a first pole piece in concentrically spaced relationship relative to said center pole piece. The stator core thereby has a circular top portion and an open end disposed opposite said top portion and facing an armature in the fuel injector. The first pole piece is cylindrical in shape and substantially circular in cross-section extending in a direction perpendicular to said circular top portion, and the center pole piece is concentrically disposed in spaced relationship relative to said cylindrical first pole piece and extends in a direction perpendicular to said cylindrical top portion.

17 Claims, 2 Drawing Sheets

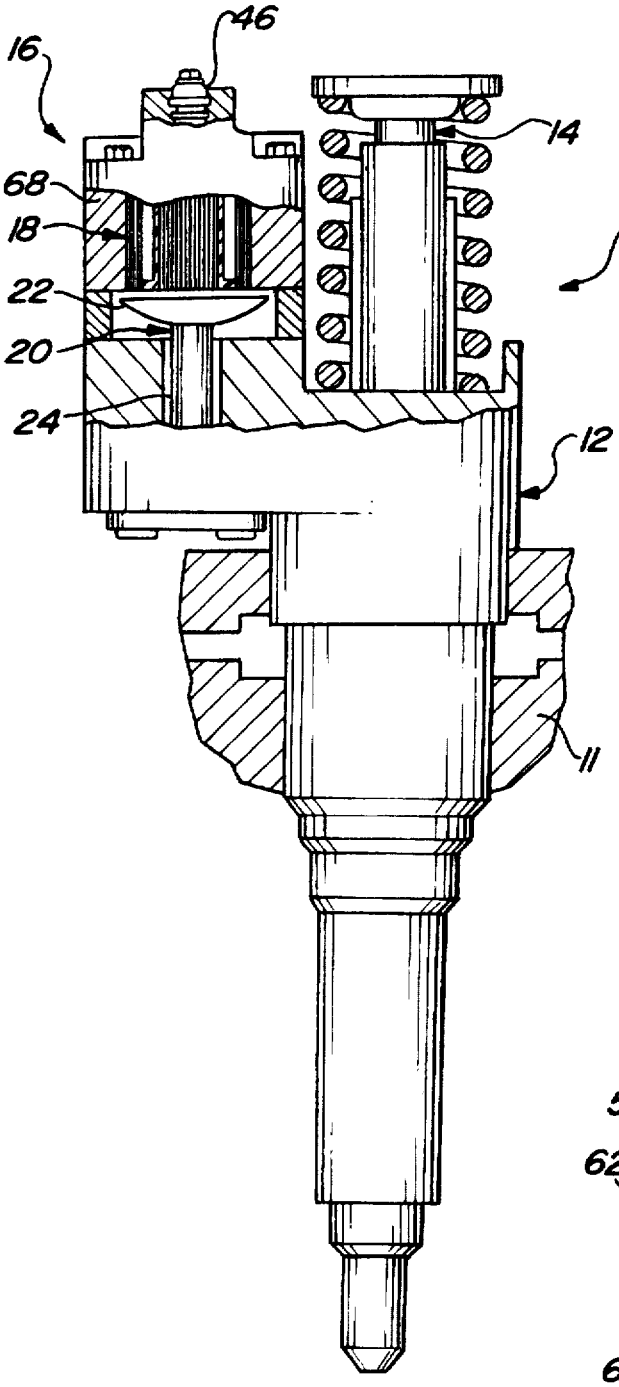
Fig - 1
Fig - 4
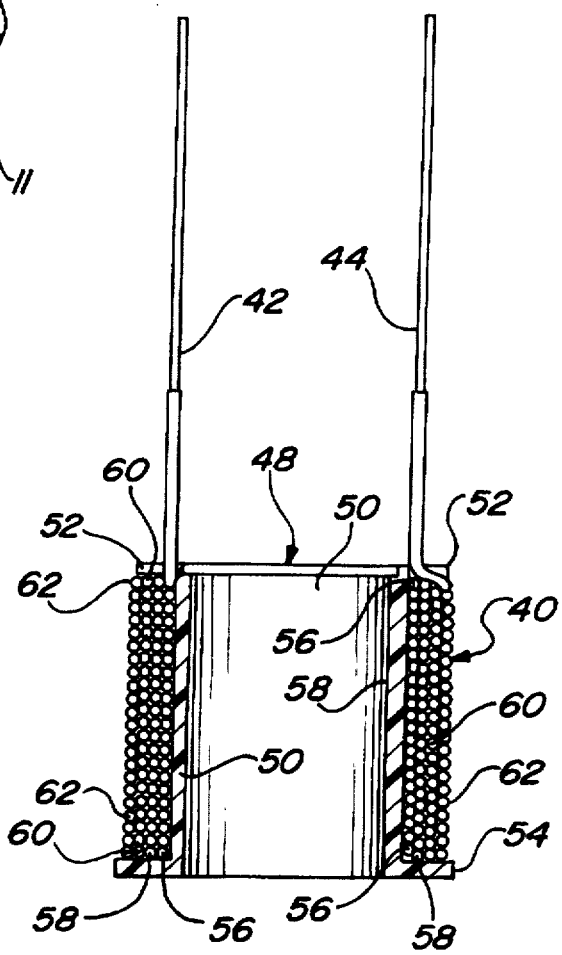

SOLENOID STATOR ASSEMBLY FOR AN ELECTROMECHANICALLY ACTUATED FUEL INJECTOR

BACKGROUND OF INVENTION

1. Field of the Invention

The present invention relates, generally, to solenoid stator assemblies and, in particular, to solenoid stator assemblies for electromechanically actuated fuel injectors.

2. Description of the Related Art

Fuel injector assemblies are employed in internal combustion engines for delivering a predetermined, metered mixture of fuel and air to the combustion chamber at predetermined intervals. In the case of compression ignition or diesel engines, the fuel-air mixture is delivered at relatively high pressures, e.g. as much as 28,000 psi.

The demand for increased vehicle performance and fuel economy has been matched by equally stringent demands for lower manufacturing costs. These competing demands have increased the need for more sophisticated fuel injection systems. Microprocessor technology has become a cost effective means for resolving the competing interests of improved performance and reduced manufacturing costs. More specifically, the application of micro-processor technology to fuel injection systems have lead to the development of electronically controlled fuel injectors.

Electronically controlled fuel injectors have the advantage of being compatible with the electronically controlled engines used in the general automotive industry and have been adopted by major producers of engines.

One example of an electromechanically actuated fuel injector is shown in the U.S. Pat. No. 4,568,021 and assigned the assignee of the present invention. As disclosed in the '021 patent, injection pressure is provided by a mechanically actuated plunger.

A solenoid assembly is employed to actuate a valve to control injection timing and fuel metering.

Improvements in this field have continued as evidenced, for example, in U.S. Pat. No. 5,155,461 which discloses a Solenoid Stator Assembly For Electronically Actuated Fuel Injectors And Method of Manufacturing Same.

The '461 patent is assigned to the assignee of the present invention and includes a E-shaped stator core having a top portion, two outer pole pieces located at each end of the top portion and a central pole piece located between the two outer pole pieces. Thus, the arrangement of the outer pole pieces and center pole piece with respect to the top portion combine to form the shape of a "E". The solenoid and stator assembly disclosed the '461 patent contributes to the overall advantages of electronically controlled fuel injectors including fewer moving parts, less weight, lower maintenance requirements and less costs.

However, there remains certain disadvantages associated with the stators of the related art. More specifically the magnetic flux generated in the E-shaped stator core necessary to actuate the armature is somewhat inefficient. This is due to losses associated with the magnetic flux as it forms about the poles and the open spaces therebetween in the E-shaped stator. In order to compensate for such losses, larger stators are required.

Another competing interest which affects the design of fuel injector systems for automotive engines involves the space occupied by the injection system. This design parameter is commonly referred to as "packaging" and includes the overall objective of reducing the amount of space that components occupy.

While the electronically controlled fuel injection systems of the related art have performed well in the past, there remains a need to provide such systems which can operate under the strict operating and manufacturing parameters mentioned above while occupying the smallest space possible.

SUMMARY OF THE INVENTION

The present invention overcomes the disadvantages in the related art in an efficient, cost effective solenoid stator assembly for an electromagnetically actuated fuel injector. The solenoid stator assembly includes a cup shaped stator core assembly having a circular top portion and an open end disposed opposite the top portion and facing the armature. The stator core assembly also includes a first pole piece which is cylindrical in shape and substantially circular in cross-section extending in a direction perpendicular to the circular top portion. The assembly further includes a center pole piece concentrically disposed in spaced relationship relative to the cylindrical first pole piece and extending in a direction perpendicular to the cylindrical top portion. A wire coil having first and second leads is electrically connected to a pair of terminals. The wire coil is wound in distinct layers about the center pole piece in a predetermined manner such that adjacent wire elements in each distinct layer of the coil are juxtaposed in preordered, side-by-side relationship relative to each other. The assembly further includes a cup shaped insulator covering the circular top portion and a portion of the cylindrical first pole piece. A housing is molded about and substantially envelopes the stator core and the cup shaped insulator except for the open end of the stator core.

The cup shaped stator core assembly generates a more efficient magnetic flux pattern which generates a greater electromagnetic force acting on the armature than stator assemblies disclosed in the related art. Thus, it is possible to reduce the size of the solenoid stator assembly while, at the same time, generating a sufficient magnetic force to actuate the armature and provide sufficient fuel in metered quantities at predetermined times to the injector mechanism.

Other objects, features and advantages of the present invention will be readily appreciated as the same becomes better understood after reading the subsequent description taken in conjunction with the accompanying drawings.

BRIEF DESCRIPTION OF THE DRAWINGS

FIG. 1 is a partially sectional side view of an electromechanically actuated fuel injector including the solenoid stator assembly of the present invention;

FIG. 4 is an enlarged cross-sectional side view illustrating the wire coil wound in distinct radially extending layers about the coil insulator of the present invention.

DESCRIPTION OF THE PREFERRED EMBODIMENT(S)

Figure 2:
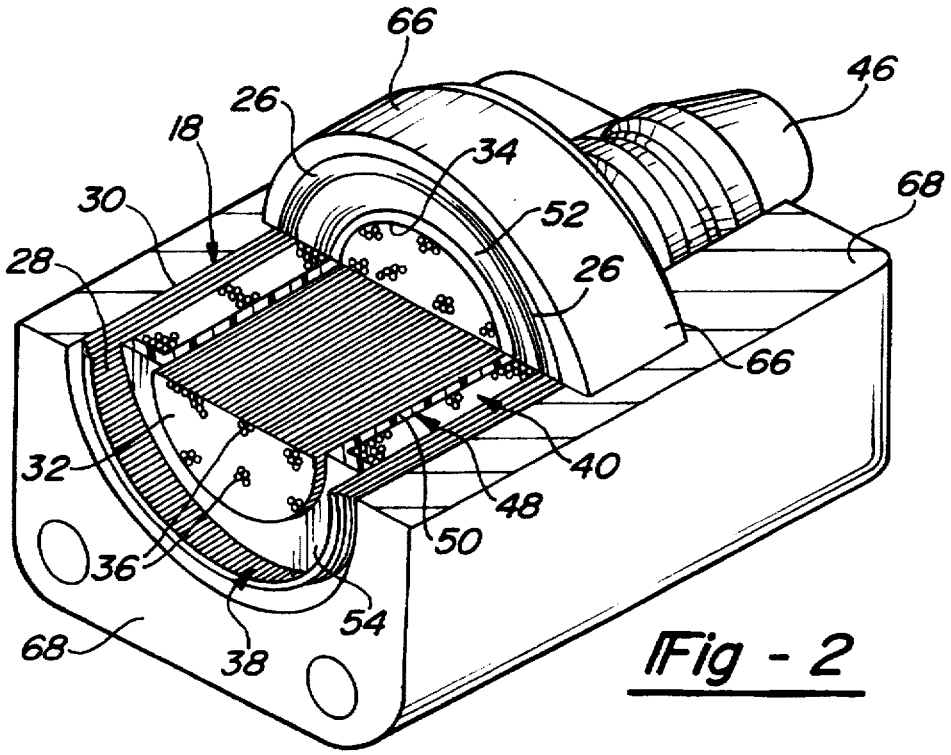
FIG. 2 is a perspective view of the solenoid stator assembly shown substantially sectioned along the same vertical plane as the partially sectioned view in FIG. 1.

An electromechanically actuated fuel injector assembly is generally shown at 10 in FIG. 1. The fuel injector assembly 10 is typically mounted to an engine 11. The fuel injector assembly 10 includes an injector body, generally indicated at 12, and a plunger, generally indicated at 14, which is reciprocally received in a bore (not shown) of the injector body 12. A solenoid assembly, generally shown at 16, is located to one side of the plunger 14 as shown in FIG. 1. The solenoid assembly 16 includes a cup shaped stator core assembly, generally indicated at 18 and an armature, generally indicated at 20. The armature 20 has a head 22 and a stem 24 which is moveable in response to an electromagnetic force generated by the stator core assembly 18 to open and close a valve (not shown) which regulates the flow of fuel to the bore in the injector body 12.

Figure 3:
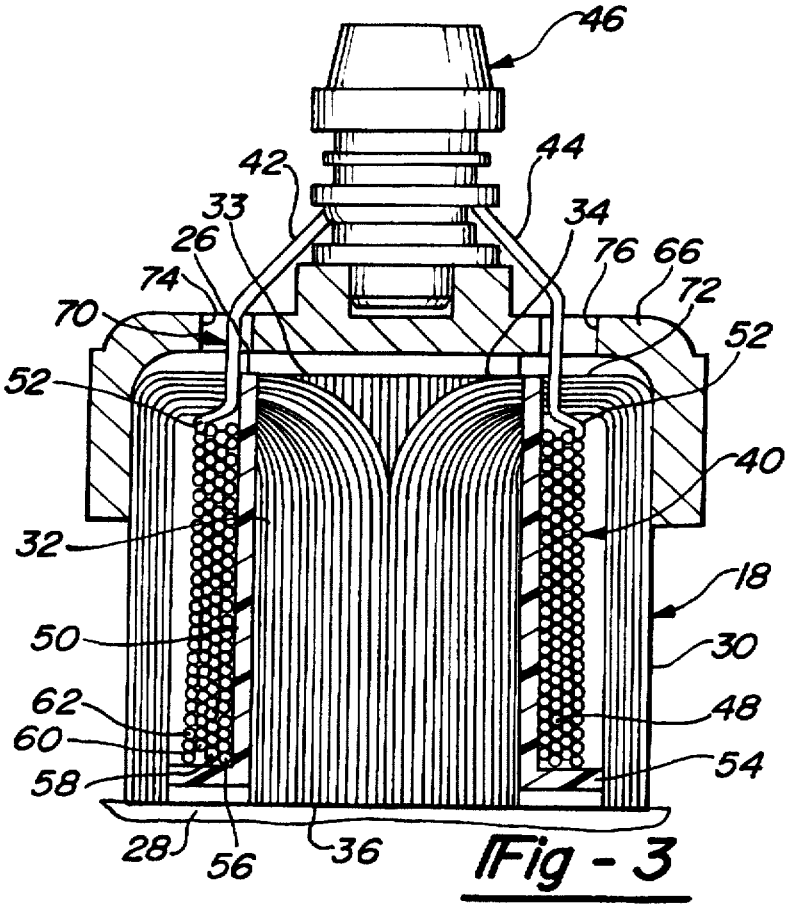
FIG. 3 is an enlarged cross-sectional side view of the cup shaped stator core assembly and insulator of the present invention.

As best shown in FIGS. 2 and 3, the cup shaped stator core assembly 18 includes a circular top portion 26 and an open end 28 disposed opposite the top portion 26 and facing the armature 20. The stator core assembly 18 includes a first pole piece 30 and a central pole piece 32. The stator core assembly is comprised of a plurality of magneto-conductive wire members 36 of some predetermined length. The wire members are arranged in parallel abutting relationship relative to any adjacent wire member along the length thereof. The wire bundle is confined or bound at one end for some length which is less than the entire length of the wire bundle to form the center pole piece 32, and allowed to splay umbrella like at its other end to form the first pole piece. The resulting orientation of the first pole piece to the center pole is as follows. Specifically, the first pole piece is continuous with and extends in concentric relationship relative to the center pole. The center pole piece extends perpendicular to the cylindrical top portion 26. Thus it can be easily understood by those of ordinary skill in the art that the first pole piece is cylindrical in shape when seen on a side view, and is substantially circular in cross-section. The center pole piece 32 is concentrically disposed in spaced relationship relative to the cylindrical first pole piece 30. The center pole piece 32 also extends perpendicular to the cylindrical top portion 26 for the greater part of its length. It is further understood by those skilled in the art that since it is continuous with the center pole piece, top portion 26 is formed of a portion of the wire bundle. Thus, the splayed, umbrella like structure so defined should be apparent to those of skill in the art.

As best shown in FIG. 3, the cylindrical top portion 26 and the cylindrical first pole piece 30 are formed of a continuous wire bundle 31. The center pole piece 32 is formed by the same continuous wire bundle 31 as the cylindrical top portion 26 and the first pole piece 30. The continuous wire bundle is made up of a plurality of individual, magneto-conductive wire members 36. Each of the wire members 36 extend continuously in abutting relationship relative to an adjacent wire member. The members 36 which form the wire bundle of the center pole piece 32 all extend perpendicular to the top portion 26 of the stator core assembly 18. The cylindrical first pole piece 30 may extends any length from the top portion 26. Preferably, the length that the first pole piece and the center pole piece 32 are equal so that the ends thereof form a plane.

A wire coil, generally indicated at 40, includes first and second leads 42, 44 electrically connected to a pair of terminals, one of which is shown at 46 located at the top of the solenoid assembly 16. The wire coil 40 is wound about the center pole piece 32. More specifically, a coil insulator, generally indicated at 48 is disposed about the center pole piece 32 between the wire coil 40 and the center pole piece 32. The previously discussed wire bundle is passed through the coil insulator and may be used to bind one end of the wire bundle together to form the center pole and the other end of the wire bundle is allowed to splay umbrella-like at its opposite end around the coil insulator to form the concentric first pole piece.

As best shown with reference to FIG. 4, the coil insulator 48 includes a cylindrical spool 50 made of non-conductive material such as plastic and having a pair of flanges 52, 54 extending orthogonally relative to the cylindrical spool 50. One of the pair of flanges 52, 54 is disposed at either end of the cylindrical spool 50. The wire coil 40 is wound in discrete radially extending layers 56, 58, 60, 62 about the cylindrical spool 50 in a predetermined manner such that adjacent wire elements in each distinct radially extending layer 56, 58, 60, 62, respectively, are juxtaposed in preordered, side-by-side relationship relative to each other and between the pair of flanges 52, 54. The ordered, i.e. not random, arrangement of the wire elements disposed in distinct layers increases the magnetic flux generated by the stator assembly resulting in the design of a smaller stator core assembly 18 to activate the armature 20.

Referring once again to FIGS. 2 and 3, a cup shaped insulator 66 covers the circular top portion 26 and the upper portion of the cylindrical first pole piece 30. A housing 68 is molded about and substantially envelopes the stator core assembly 18 as well as the cup shaped insulator 66 except for the open end 28 of the stator core assembly. The leads 42 and 44 extend through the top portion at points 70 and 72 which correspond to a pair of apertures 74, 76 in the cup shaped insulator 66.

The first lead 42 extends through the top portion at point 70 and aperture 74 in the top portion 26 and insulator 66, respectively. Similarly, the second lead 44 extends through point 72 and aperture 76 in the top portion 26 and cup shaped insulator 66, respectively.

In this way, the solenoid stator assembly of the present invention may be employed in an electromechanically actuated fuel injector to generate a more efficient magnetic flux pattern which generates a greater electromagnetic force acting on the armature. More specifically, the cylindrical first pole piece 30 surrounding the concentrically disposed second pole piece 32 more efficiently prevents leaks of the magnetic flux pattern. In addition, the preordered disposition of the adjacent wire elements in each distinct layer 56, 58, 60, 62 of the wire coil 40 acts to improve the electromagnetic force such that a smaller solenoid assembly may be employed for a given fuel injector system. Thus, it is possible to reduce the size of the solenoid stator assembly for an electromechanically actuated fuel injector while, at the same time, generating a sufficient magnetic force to actuate the armature and providing sufficient fuel in metered quantities at predetermined times to the injector assembly.

The present invention has been described in an illustrative manner. It is to be understood that the terminology which has been used is intended to be in the nature of words of description rather than of limitation.

Many modifications and variations of the present invention are possible in light of the above teachings. Therefore, within the scope of the appended claims, the present invention may be practiced other than as specifically described.

What is claimed is:

1. A solenoid stator assembly for an electromechanically actuated fuel injector, said solenoid stator assembly comprising:

a cup shaped stator core assembly comprised of a plurality of magneto-conductive wire members of a predetermined length arranged in parallel, adjacent and abutting relationship relative to an adjacent wire member; said plurality of wire members bound at one end thereof for some length less than the entire length of the wire members to form a central pole piece, and splayed umbrella like about the central pole piece at the opposite end thereof to form a first pole piece in concentrically spaced relationship relative to said is center pole piece; said stator core thereby having a circular top portion and an open end disposed opposite said top portion and facing an armature, said first pole piece cylindrical in shape and substantially circular in cross-section extending in a direction perpendicular to said circular top portion, said center pole piece concentrically disposed in spaced relationship relative to said cylindrical first pole piece and extending in a direction perpendicular to said cylindrical top portion, a wire coil having first and second leads electrically connected to a pair of terminals, said wire coil wound in distinct layers about said center pole piece in a predetermined manner such that adjacent wire elements in each distinct layer of said coil are juxtaposed in pre-ordered side by side relationship relative to each other;

a cup shaped insulator covering said circular top portion and a portion of said cylindrical first pole piece;

a housing molded about and substantially enveloping said stator core assembly and said cup shaped insulator except for said open end of said stator core assembly.

2. A solenoid stator assembly as set forth in claim 1 wherein a coil insulator is disposed about said second pole piece between said wire coil and said second pole piece.

3. A solenoid stator assembly as set forth in claim 2 wherein said coil insulator includes a cylindrical spool having a pair of flanges extending orthogonally relative to said cylindrical spool with one of said pair of flanges disposed at either end of said cylindrical spool.

4. A solenoid stator assembly as set forth in claim 3, wherein said wire coil is wound in discrete layers about said cylindrical spool in a predetermined manner such that adjacent wire elements in each distinct layer are juxtaposed in a pre-ordered, side by side relationship relative to each other and between said pair of flanges.

5. A solenoid stator assembly as set forth in claim 1 wherein said cylindrical top portion, said cylindrical first pole piece and said center pole piece being formed by a laminated wire bundle.

6. A solenoid stator assembly as set forth in claim 1 wherein said cylindrical first pole piece and said center pole piece are of equal length so that the ends thereof form a plane.

7. A solenoid stator assembly for an electromechanically actuated fuel injector, said solenoid stator assembly comprising:

a cup shaped stator core assembly comprised of a plurality of magneto-conductive wire members of a predetermined length arranged in parallel, adjacent and abutting relationship relative to an adjacent wire member; said plurality of wire members bound at one end thereof for some length less than the entire length of the wire members to form a central pole piece, and splayed umbrella like about the central pole piece at the opposite end thereof to form a first pole piece in concentrically spaced relationship relative to said center pole piece; said stator core thereby having a circular top portion and an open end disposed opposite said top portion and facing an armature, said first pole piece cylindrical in shape and substantially circular in cross-section extending in a direction perpendicular to said circular top portion, said center pole piece concentrically disposed in spaced relationship relative to said cylindrical first pole piece and extending in a direction perpendicular to said cylindrical top portion, a wire coil having first and second leads electrically connected to a pair of terminals, said wire coil wound in distinct layers about said center pole piece in a predetermined manner such that adjacent wire elements in each distinct layer of said coil are juxtaposed in pre-ordered side by side relationship relative to each other;

a coil insulator is disposed about said second pole is piece between said wire coil and said second pole piece;

a cup shaped insulator covering said circular top portion and a portion of said cylindrical first pole piece;

a housing molded about and substantially enveloping said stator core assembly and said cup shaped insulator except for said open end of said stator core assembly.

8. A solenoid stator assembly as set forth in claim 7, wherein said coil insulator includes a cylindrical spool having a pair of flanges extending orthogonally relative to said cylindrical spool with what of said pair of flanges disposed at either end of said cylindrical spool.

9. A solenoid stator assembly as set forth in claim 8, wherein said wire coil is wound in discrete layers about said cylindrical spool in a predetermined manner such that adjacent wire elements in each distinct layer are juxtaposed in a pre-ordered, side by side relationship relative to each other and between said pair of flanges.

10. A solenoid stator assembly as set forth in claim 7, wherein said cylindrical top portion, said cylindrical first pole piece and said center pole piece being formed by a laminated wire bundle.

11. A solenoid stator assembly as set forth in claim 8, wherein said cylindrical first pole piece and said center pole piece are of equal length so that the ends thereof form a plane.

12. An electromechanically actuated fuel injector assembly comprising:

an injector body and a plunger reciprocally received in a bore of said injector body;

a solenoid assembly including a cup shaped stator core assembly and an armature, said armature having a head and a stem and being moveable in response to an electromagnetic force generated by said stator core assembly to open and close a valve which regulates the flow of fuel to the bore in said injector body;

a cup shaped stator core assembly comprised of a plurality of magneto-conductive wire members of a predetermined length arranged in parallel, adjacent and abutting relationship relative to an adjacent wire member; said plurality of wire members bound at one end thereof for some length less than the entire length of the wire members to form a central pole piece, and splayed umbrella like about the central pole piece at the opposite end thereof to form a first pole piece in concentrically spaced relationship relative to said center pole piece; said stator core thereby having a circular top portion and an open end disposed opposite said top portion and facing an armature, said first pole piece cylindrical in shape and substantially circular in cross-section extending in a direction perpendicular to said circular top portion, said center pole piece concentrically disposed in spaced relationship relative to said cylindrical first pole piece and extending in a direction perpendicular to said cylindrical top portion, a wire coil having first and second leads electrically connected to a pair of terminals, said wire coil wound in distinct layers about said center pole piece in a predetermined manner such that adjacent wire elements in each distinct layer of said coil are juxtaposed in pre-ordered side by side relationship relative to each other;

a cup shaped insulator covering said circular top portion and a portion of said cylindrical first pole piece;

a housing molded about and substantially enveloping said stator core assembly and said cup shaped insulator except for said open end of said stator core assembly.

13. An electromechanically actuated fuel injector assembly as set forth in claim 12, wherein a coil insulator is disposed about said second pole piece between said wire coil and said second pole piece.

14. An electromechanically actuated fuel injector assembly as set forth in claim 13, wherein said coil insulator includes a cylindrical spool having a pair of flanges extending orthogonally relative to said cylindrical spool with one of said pair of flanges disposed at either end of said cylindrical spool.

15. An electromechanically actuated fuel injector assembly as set forth in claim 14, wherein said wire coil is wound in discrete layers about said cylindrical spool in a predetermined manner such that adjacent wire elements in each distinct layer are juxtaposed in a pre-ordered, side by side relationship relative to each other and between said pair of flanges.

16. A solenoid stator assembly as set forth in claim 14, wherein said cylindrical top portion, said cylindrical first pole piece and said center pole piece being formed by a laminated wire bundle.

17. An electromechanically actuated fuel injector assembly as set forth in claim 12, wherein said cylindrical first pole piece and said center pole piece are of equal length so that the ends thereof form a plane.

* * * * *